US009173032B2

(12) United States Patent
Brungart et al.

(10) Patent No.: US 9,173,032 B2
(45) Date of Patent: Oct. 27, 2015

(54) METHODS OF USING HEAD RELATED TRANSFER FUNCTION (HRTF) ENHANCEMENT FOR IMPROVED VERTICAL-POLAR LOCALIZATION IN SPATIAL AUDIO SYSTEMS

(71) Applicant: The United States of America as Represented by the Secretary of the Air Force, Washington, DC (US)

(72) Inventors: Douglas S. Brungart, Rockville, MD (US); Griffin D. Romigh, Beloit, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 312 days.

(21) Appl. No.: 13/832,831

(22) Filed: Mar. 15, 2013

(65) Prior Publication Data

US 2013/0202117 A1 Aug. 8, 2013

Related U.S. Application Data

(63) Continuation-in-part of application No. 12/783,589, filed on May 20, 2010, now Pat. No. 8,428,269.

(60) Provisional application No. 61/179,754, filed on May 20, 2009.

(51) Int. Cl.

| | |
|---|---|
| ***H04R 5/04*** | (2006.01) |
| ***H04S 7/00*** | (2006.01) |
| *H04S 5/00* | (2006.01) |

(52) U.S. Cl.
CPC *H04R 5/04* (2013.01); *H04S 7/304* (2013.01); *H04R 2430/03* (2013.01); *H04S 5/00* (2013.01); *H04S 2420/01* (2013.01); *H04S 2420/11* (2013.01)

(58) Field of Classification Search
None
See application file for complete search history.

(56) References Cited

U.S. PATENT DOCUMENTS

| | | | | |
|---|---|---|---|---|
| 6,118,875 | A * | 9/2000 | M.o slashed.ller et al. | 381/1 |
| 6,243,476 | B1 * | 6/2001 | Gardner | 381/303 |
| 8,428,269 | B1 * | 4/2013 | Brungart et al. | 381/17 |
| 8,638,946 | B1 * | 1/2014 | Mahabub | 381/17 |
| 2009/0214045 | A1 * | 8/2009 | Fukui et al. | 381/17 |

* cited by examiner

*Primary Examiner* — Wayne Young
*Assistant Examiner* — Mark Fischer
(74) *Attorney, Agent, or Firm* — AFMC LO/JAZ; Chastity Whitaker

(57) ABSTRACT

A method of enhancing vertical polar localization of a head related transfer (HRTF). The method includes splitting an audio signal and generating left and right output signals by determining a log lateral component of the respective frequency-dependent audio gain that is equal to a median log frequency-dependent audio gain for all audio signals of that channel having a desired perceived source location. A vertical magnitude of the respective audio signal is enhanced by determining a log vertical component of the respective frequency-dependent audio gain that is equal to a product of a first enhancement factor and a different between the respective frequency-dependent audio gain at the desired perceived source location and the lateral magnitude of respective audio signal. The output signals are time delayed according to an interaural time.

12 Claims, 7 Drawing Sheets

METHODS OF USING HEAD RELATED TRANSFER FUNCTION (HRTF) ENHANCEMENT FOR IMPROVED VERTICAL-POLAR LOCALIZATION IN SPATIAL AUDIO SYSTEMS

RIGHTS OF THE GOVERNMENT

The invention described herein may be manufactured and used by or for the Government of the United States for all governmental purposes without the payment of any royalty.

Pursuant to 37 C.F.R. §1.78(a)(4), this application claims the benefit of and priority to prior filed Provisional Application Ser. No. 61/179,754, entitled, "Head Related Transfer Function (HRTF) Enhancement for Improved Vertical-Polar Localization in Spatial Audio Displays," filed on May 20, 2009, and Non-Provisional application Ser. No. 12/783,589, entitled, "Head Related Transfer Function Enhancement for Improved Vertical-Polar Localization in Spatial Audio Systems," which issued as U.S. Pat. No. 8,428,269 on Apr. 23, 2013. The disclosures of these applications are expressly incorporated herein by reference in their entireties.

FIELD OF THE INVENTION

The invention relates generally to methods of spatial location and, more particularly, to methods of enhancing head-related transfer functions (HRTFs).

BACKGROUND OF THE INVENTION

Head related transfer functions (HRTFs) are digital audio filters that reproduce direction-dependent changes that occur in the magnitude and phase spectra of an auditory signal reaching the left and right ears when the location of the sound source changes relative to the listener. HRTFs can be a valuable tool for adding realistic spatial attributes to arbitrary sounds presented over stereo headphones. However, conventional HRTF-based virtual audio systems have rarely been able to reach the same level of localization accuracy that would be expected for listeners attending to real sound sources in the free field.

Since the 1970s, audio researchers have known that the apparent location of a simulated sound can be manipulated by applying a linear transformation. HRTFs, to the sound prior to its presentation to the listener over headphones. In effect, the HRTF processing technique works by reproducing the interaural differences in time and intensity that listeners use to determine the left-right positions of sound sources and the pinna-based spectral shaping cues that listeners use for determining the up-down and front-back locations of sounds in the free field.

If the HRTF measurement and reproduction techniques are properly implemented, then it may be possible to produce virtual sounds over headphones that are completely indistinguishable from sounds generated by a real loudspeaker at a location where the HRTF measurement was made. Indeed, this level of real-virtual equivalence has been demonstrated in experiments where listeners were unable to reliably distinguish the difference between sequentially-presented real and virtual sounds. However, demonstrations of this level of virtual sound fidelity have been limited to carefully controlled, laboratory environments where the HRTF has been measured with the headphone used for reproducing the HRTF, and the listener's head was fixed from the time the HRTF measurement was made to the time the virtual stimulus was presented to the listener.

Virtual audio display systems allow listeners to make exploratory head movements while wearing removable headphones; however, it has historically been very difficult to achieve a level of localization performance that is comparable to free field listening. Listeners are generally able to determine lateral locations of virtual sounds because these left-right determinations are based on interaural time delays (ITDs) and interaural level differences (ILDs) that are relatively robust across a wide range of listening conditions. However, listeners generally have extreme difficulty distinguishing between virtual sound locations that lie within a so-called "cone-of-confusion," FIG. 1 illustrates such a conventional cone of confusion 10 where all possible source locations that produce roughly the same LLD and ITD cues are positioned at an angle, β, from an interaural x-y-z axis 12. Within this cone 10, localization judgments have to be made solely on the basis of spectral cues generated by the direction-dependent filtering characteristics of the listener's external ear. If spectral cues are not precisely reproduced by the virtual audio display system, then poor localization performance in elevation may result.

There are at least three factors that contribute to the difficulty in producing a level of spectral fidelity to allow virtual sounds located within the cone of confusion 10 to be localized as accurately as free-field sounds. One such factor relates to the variability in frequency response that occurs across different fittings of the same set of stereo headphones on a listener's head. In most practical headphone designs, the variations in frequency response that occur when headphones are removed and replaced on a listener's head are comparable in magnitude to the variations in frequency response that occur in the HRTF when a sound source changes location within the cone of confusion 10. This means that in most applications of spatial audio, free-field equivalent elevation performance can only be achieved in laboratory settings where the headphones are never removed from the listener's head between the time when the HRTF measurement is made and the time the headphones are used to reproduce the simulated spatial sound.

In a controlled laboratory setting used by KULKARNI, it was possible to place the headphones on the listener's head, use probe microphones inserted into the ears to measure the frequency response of the headphones, create a digital filter to invert that frequency response, and use that digital filter to reproduce virtual sounds without ever removing the headphones (KULKARNI, A. et al., "Sensitivity of human subjects to bead-related transfer function phase spectra," *Journal of the Acoustical Society of America*, Vol. 105 (1999) 2821-2840, the disclosure of which is incorporated herein by reference, in its entirety). This precise level of headphone correction is unachievable in real-world applications of spatial audio, particularly where display designers must account for the fact that the headphones will be removed and replaced prior to each use of the system.

Another factor that can lead to reduced localization accuracy in conventional spatial audio systems is the use of interpolation to obtain HRTFs for locations of which no actual HRTF has been measured. Most studies of auditory localization accuracy with virtual sounds have used fixed impulse responses measured at discrete sound locations to do virtual synthesis. However, most practical spatial audio systems use some form of real-time head-tracking, which requires an interpolation of HRTFs between measured source locations. A number of different interpolation schemes have been developed for HRTFs, but whenever it becomes necessary to use interpolation techniques to infer information about missing HRTF locations there is some possibility for a reduction in fidelity in the virtual simulation.

Another factor that has a detrimental impact on localization accuracy in conventional spatial audio systems is the use of individualized HRTFs in order to achieve optimum localization accuracy. The physical geometry of the external ear (or pinna) varies between listeners and, as a direct consequence, there are substantial differences in the direction-dependent high-frequency spectral cues that listeners use to localize sounds within the cone-of-confusion 10. When a listener uses a spatial audio system that is based on HRTFs measured of another listener's ears, substantial increases in localization error can occur.

Conventional attempts to overcome these factors have included enhancement methodologies, such as individualization techniques, that are designed to bridge the gap between the relatively high level of performance typically seen with individualized HRTF rendering and the relatively poor level of performance that is typically seen with non-individualized HRTFs. An early example of such a system provided listeners with the ability to manually adjust the gain of the HRTF in different frequency hands to achieve a higher level of spatial fidelity. Further, conventional HRTF enhancement algorithms have focused on improving performance for non-individualized HRTFs and have not been shown to improve performance for individualized HRTFs.

While there is evidence that these customization techniques can improve localization performance, additional modification to the HRTF is necessary to match the characteristics of the individual listener. Still, many applications exist in which this approach is not practical and the designer will need to assume that all users of the system will be listening to the same set of unmodified non-individualized HRTFs. To this point, only a few techniques have been proposed that are designed to improve localization performance on a fixed set of HRTFs for an arbitrary listener.

SUMMARY OF THE INVENTION

The present invention overcomes the foregoing problems and other shortcomings, drawbacks, and challenges of convention implementations of HRTFs in spatial audio systems. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention a method of enhancing vertical polar localization of a head related transfer function includes splitting an audio signal and generating left and right output signal by enhancing a left lateral magnitude of the respective signal by determining a log lateral component of the respective frequency-dependent audio gain that is equal to a median log frequency-dependent audio gain for all audio signals of that channel having an desired one of the plurality of perceived source locations. A vertical magnitude of the respective audio signal is enhanced by determining a log vertical component of the respective frequency-dependent audio gain that is equal to a product of a first enhancement factor and a difference between the respective frequency-dependent audio gain at the desired one of the plurality of perceived source locations and the lateral magnitude of respective audio signal. The output signals are time delayed according to an interaural time and delivered to left and right ears of a listener.

Another embodiment of present invention is directed to a method of using a head related transfer function to enhance polar localization of an audio signal includes determining a magnitude response for each channel of the audio signal. The magnitude response is decomposed to a polar-coordinate system and enhanced. The enhanced responses for each channel of the audio signal are then combined.

Still another embodiment of the present invention is directed to a method or applying a head related transfer function to each channel of an audio signal that includes enhancing a left lateral magnitude of each channel of the audio signal by determining a log lateral component of a frequency-dependent audio gain that is equal to a median log frequency-dependent audio gain for all audio signals having an desired one of the plurality of perceived, source locations. A vertical magnitude of each channel of the audio signal is then enhanced.

Additional objects, advantages, and novel features of the invention will be set forth in part in the description which follows, and in part will become apparent to those skilled in the an upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated, in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION

Figure 2:
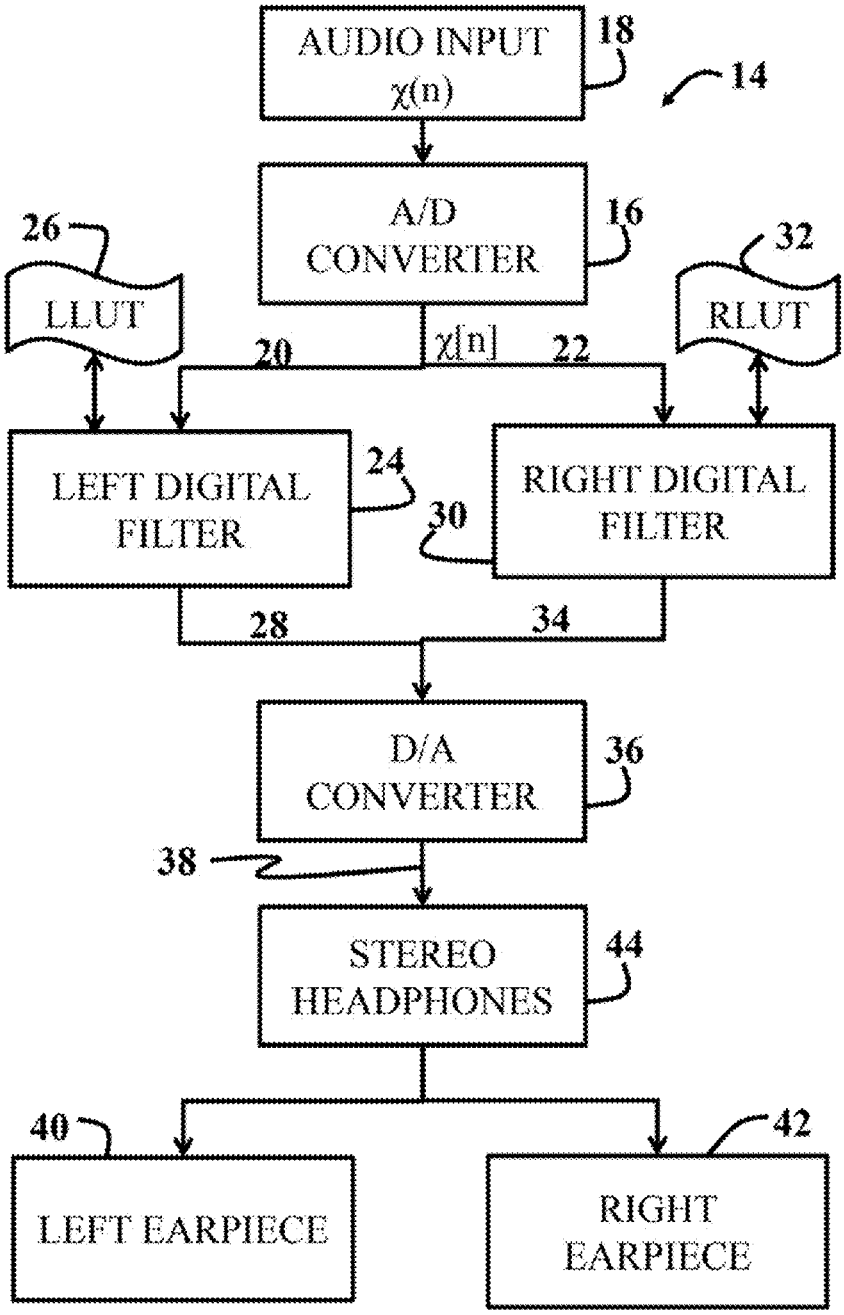
FIG. 2 is a schematic representation of a spatial audio system according to one embodiment of the present invention.

Turning now to the figures, and in particular to FIG. 2, a spatial audio system 14 according to one embodiment of the present invention is shown. The spatial audio system 14, and methods of using the same, systematically increases the salience of the direction-dependent spectral cues that listener uses to determine the elevations of a perceived sound source. In that regard, the spatial audio system 14, according to various embodiments of the present invention, is configured to produce a sound over headphones 44 that is perceived to originate from a specific spatial location relative to the listener's head 46. The system 14 according to the illustrated embodiment includes an Analog-to-Digital (A/D) converter 16 that converts an arbitrary analog audio input signal 18, $\chi(n)$, into the discrete-time signal, $\chi[n]$. The input signal 18 is separated, for example, by a signal splicer, into a left ear signal 20 and a right ear signal 22.

A left digital filter 24 having an associated left look up table 26 (illustrated as "LLUT") filters the left ear signal 20 with an enhanced left ear (ELF) HRTF, $H_{l,\theta,\phi}(j\omega)$, to create a digital left ear signal 28 for creating a desired virtual source at a location $(\theta,\phi)$. A right digital filter 30 having an associated right look up table 32 (illustrated as "RLUT") filters the right ear signal 22 with the enhanced right ear (ERE) HRTF, $H_{r,\theta,\phi}(j\omega)$, to create a digital right ear signal 34 for the desired virtual source at the location $(\theta,\phi)$.

Each HRTF may be characterized by a set of N measurement locations, defined in an arbitrary spherical coordinate system, with each location having a left ear HRTF, $h_l[n]$, and a right ear HRTF, $h_r[n]$. These HRTFs may also be defined in the frequency domain with a separate parameter indicating the interaural time delay for each measured HRTF location. The magnitudes of the left and right ear HRTFs for each location are represented in the frequency domain by two 2048-pt FFTs, $H_l(j\omega)$ and $H_r(j\omega)$, and the interaural phase information in the HRTF for each location is represented by a single interaural time delay value that best fits the slope of the interaural phase difference in the measured HRTF in the frequency range from about 251) Hz to about 750 Hz.

Suitable HRTF measurements may be obtained by any means known in the art. For example, such HRTF procedures are described in WIGHTMAN. F. et al., "Headphone simulation of free-field listening. II psychophysical validation," *Journal of the Acoustical Society of America*, Vol. 85 (868-878; GARDNER, W. et al., "HRTF measurements of a KEMAR," *Journal of the Acoustical Society of America*, (1995), 3907-3908: and ALGAZI, V. R. et al., "The CIPIC HRTF Database," in: *Proceedings of* 2001 *IEEE Workshop on Applications of Sinai Processing to Audio and Acoustics*, New Paltz, N.Y., (2001) 99-102.

Figure 3:
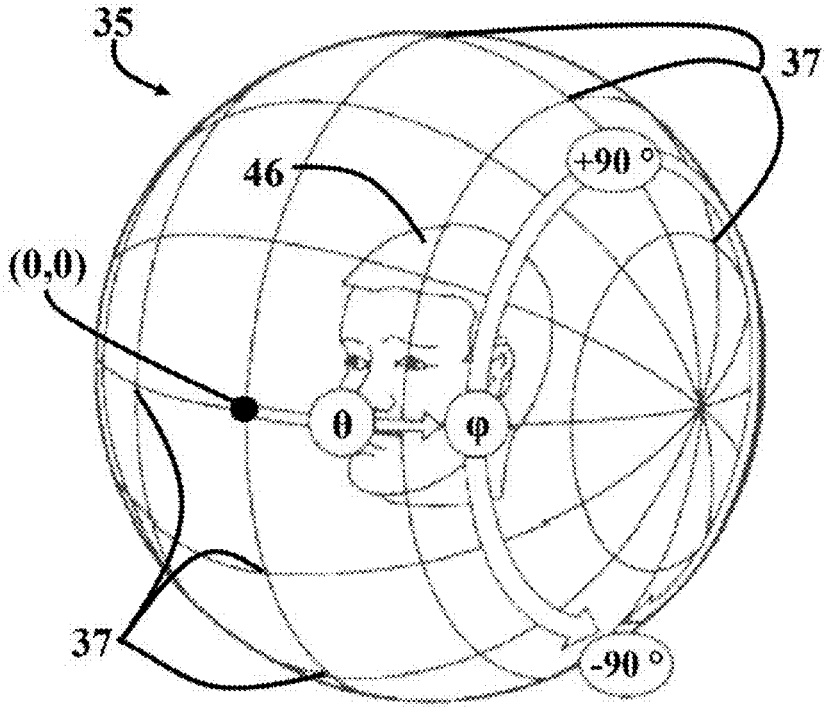
FIG. 3 is a schematic representation of an interaural-polar coordinate system, wherein the lateral angle is designated by $\theta$ and the vertical angle is designated by $\phi$.

HRTFs may be converted into an interaural polar coordinate system 12 (hereafter, "interaural coordinate system" 35), shown in FIG. 3, in which $\phi$ represents the vertical angle and is defined as the angle from the horizontal plane to a plane through the source and the interaural axis and $\theta$ represents the lateral angle and is defined as the angle from the source to the median plane. The point directly in front of the listener's head 46 is defined as the origin ($\theta$=0°, $\phi$=0°).

For each point $(\theta,\phi)$ in this interaural coordinate system 35, the time domain representation of the HRTF for the left and right ear is defined as $h_{l/r,\theta,\phi}[n]$, and the corresponding Discrete Fourier Transform (DFT) representation at angular frequency, $\omega$, is defined as $H_{l,\theta,\phi}(j\omega)$. In cases where no exact HRTF measurement is available for a point within the interaural coordinate system 35, the HRTF for the unavailable point may be interpolated using, one of any number of possible RTF interpolation algorithms.

A sampling grid is defined for the calculation of the enhanced set of HRTFs, for example, a grid having spacings (illustrated, as intersections 37) of five degrees in both in $\theta$ and $\phi$; however, the spacings may be smaller or larger depending on a desired spatial resolution. Stated another way, the LLUT 26 and RLUT 32 include measured HRTFs defined on a sampling grid of perceived sound locations that are equally spaced in both the lateral dimension ($\theta$) and the vertical dimension ($\phi$).

Within the grid, each value of $\theta$ defines the HRTFs across the cone-of-confusion 10 (FIG. 1) and for which the interaural difference cues (interaural time delay and interaural level differences) are roughly constant. The goal of the system 14 and methods described herein is to increase the salience of the spectral variations in the HRTF within the cone-of-confusion 10 (FIG. 1), which relates to the relatively difficult-to-localize vertical dimensions (in polar coordinates) without substantially distorting the interaural difference cues in the HRTF. The HRTF relates to localization in the relatively robust left-right dimension. This can be accomplished by dividing the magnitude of the HRTF within the cone-of-confusion 10 (FIG. 1) into two components: a lateral component and a vertical component.

Referring again to FIG. 2, a Digital-to-Analog (D/A) converter 36 combines the digital left and right ear signals 28, 34 and converts the combined signal into an analog signal 38, which are presented to a listeners left and right ears via left and right earpieces 40, 42 of stereo headphones 44.

According to some embodiments of the present invention, a control parameter, u, may be included to manipulate the extent to which the spectral cues related to changes in the vertical location of the sound source within a cone of confusion 10 (FIG. 1) are "enhanced" relative to the normal baseline condition with no enhancement. The implementation of $\alpha$ is based on a direct manipulation of the frequency-domain representation of an arbitrary set of HRTFs. These HRTFs may be obtained with a variety of different HRTF measurement procedures.

Figure 4:
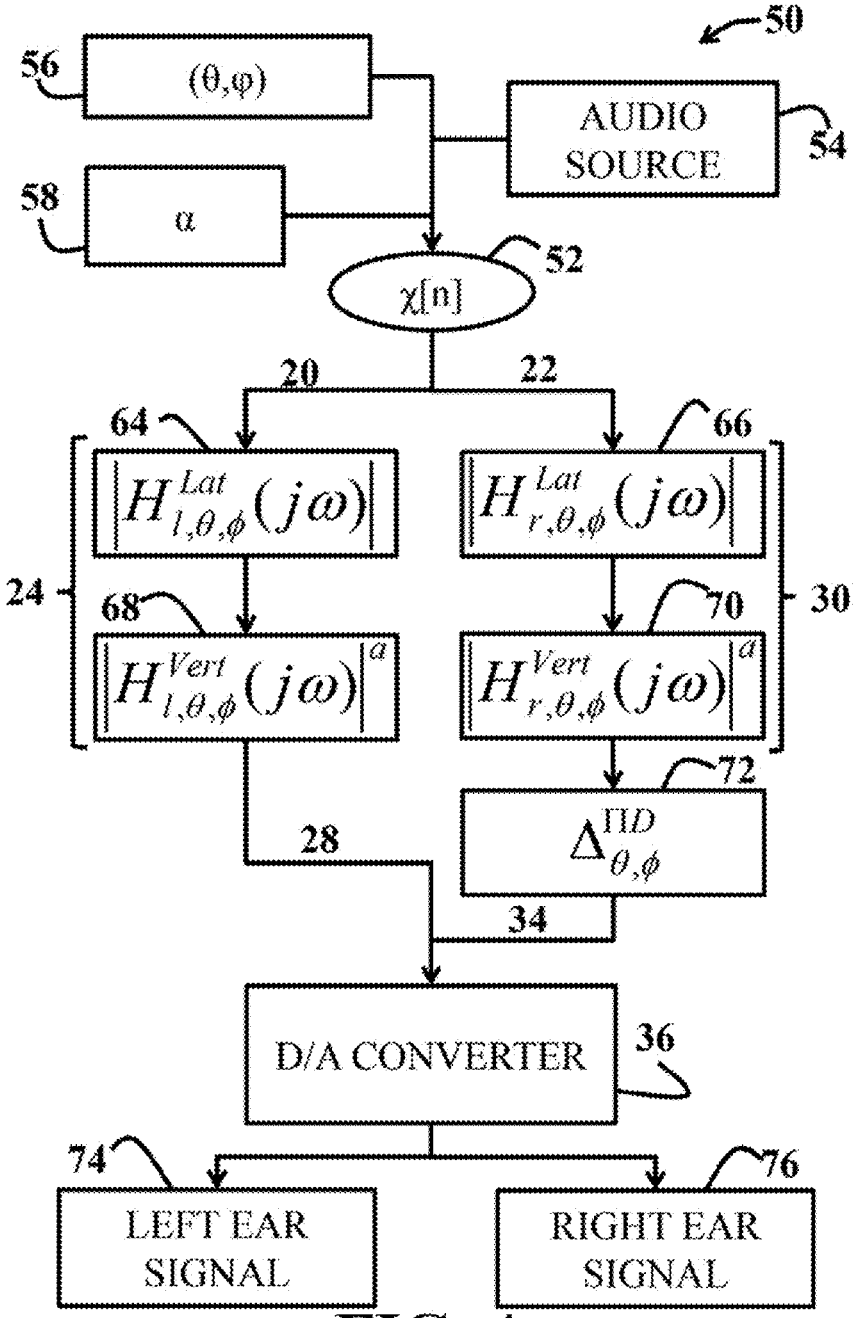
FIG. 4 is a flowchart illustrating HRTF enhancement in accordance with one embodiment of the present invention.

Turning now to FIG. 4, a flowchart 50 illustrating a method of HRTF enhancement of an audio signal is shown. The signal 52, $\chi[n]$, including an arbitrary, digitized audio input signal from an audio source 54, a desired virtual source location coordinate 56, $(\theta,\phi)$, and a desired enhancement value 58, $\alpha$, is input into the system 14 (FIG. 2). The desired enhancement value 58 may be a value that is fixed by the display designer or placed under user control with a knob.

Figure 1:
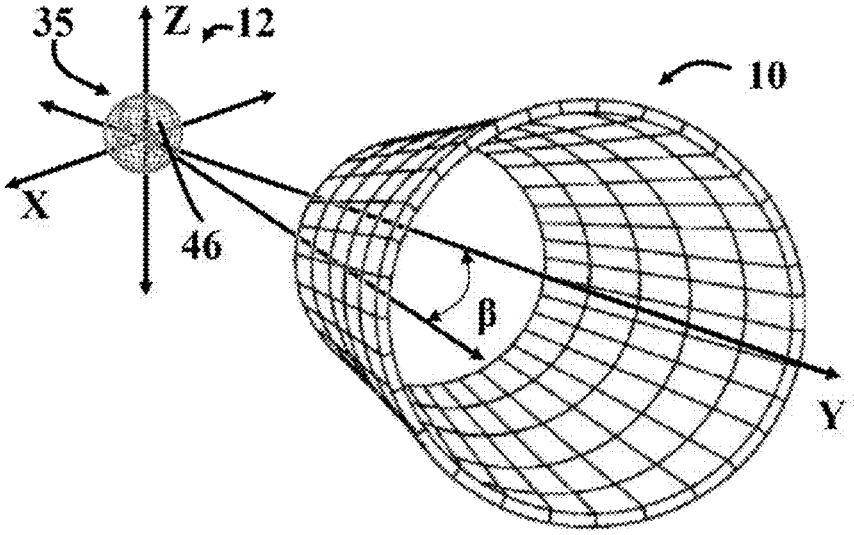
FIG. 1 is a schematic representation of a cone of confusion.

The input signal 52 is split into two components: the left ear output signal 20 and the right ear output signal 22, each of which is passed through the digital filters 24, 30. As shown in FIG. 3, the digital filters 24, 30 may include a first left digital filter 64, a first right digital filter 66, a second left digital filter 68, and a second right digital filter 70. The first filters 64, 66 may implement a magnitude transfer function of the lateral component, which is designed to capture the spectral components of the HRTF related to left-right source location. Generally, the lateral component does not vary substantially within a cone of confusion 10 (FIG. 1). The log-magnitude of the lateral component is defined by the median log-magnitude HRTF across all the vertical locations within the cone 10 (FIG. 1), and is defined by:

$$\theta=\Theta_0:20\log_{10}(|H_{l/r,\Theta_0}^{Lat}(j\omega)|)=\text{median}[20\log_{10}(|H_{l/r,\Theta_{0,\phi}}(j\omega)|)].$$

The median or mean HRTF value may be selected; however, using the mean value may minimize the effect that spurious measurements or deep notches in frequency at a single location may have on the overall left-right component of the HRTF.

It would be readily appreciated by those of ordinary skill in the art having the benefit of this disclosure that the first filters 64, 66 may change the left and right signal gain, respectively, without respectively changing the left and right time delays.

The second filters 68, 70 may implement the magnitude transfer function of the vertical component, which is defined as the magnitude ratio of the actual HRTF at each location within the cone 10 (FIG. 1) divided by the lateral component across all the locations within the cone 10 (FIG. 1):

$$|H_{l/r,\Theta_0,\phi}^{Vert}(j\omega)| = \frac{|H_{l/r,\Theta_0,\phi}(j\omega)|}{|H_{l/r,\Theta_0}^{Lat}(j\omega)|}$$

Said another way, the first filters 64, 66 add a lateral magnitude HRTF while the second filters 68, 70 add a vertical magnitude HRTF that is scaled by the enhancement factor.

Once the vertical and horizontal components are calculated for all possible polar coordinates, the enhanced HRTF at each intersection 37 in the interaural coordinate system 35 (FIG. 3) is defined by multiplying the magnitude of the lateral component of the HRTF for that a selected source location by the magnitude of the vertical component of the selected source location, raised to the exponent of α. This is mathematically equivalent to multiplying the log magnitude response of the vertical component by the factor α.

$$|H_{l/r,\alpha,\theta,\phi}^{Enh}(j\omega)|=|H_{l/r,\theta}^{Lat}(j\omega)|*|H_{l/r,\theta,\phi}^{Vert}(j\omega)|^{\alpha}$$

Here, α is defined as the gain of the elevation-dependent spectral cues in the HRTF relative to the original, unmodified HRTF. An α value of 1.0, or 100%, is equivalent to the original HRTF. For convenience, the enhanced HRTFs for a particular level of enhancement are Eα, wherein α is expressed as a percentage. The enhancement factor may be selected in real time by, for example, the listener or a system technician, or in advance: for example, by a system designer.

From this enhanced HRTF, the time domain Finite Impulse Response (FIR) filters for a 3D audio rendering may be recovered simply by taking the inverse Discrete Fourier Transform ($DFT^{-1}$) of the enhanced HRTF frequency coefficients. If necessary, HRTF interpolation techniques may also be used to convert from the interaural coordinate system 35 (FIG. 3) used for the enhancement calculations to any other grid that may be more convenient for rendering the HRTFs.

To a first approximation, the HRTF preserves the overall interaural difference cues associated with perceived sound source locations within the cone of confusion 20 and defined by the left-right angle θ. No matter what the enhancement value is set to, the overall magnitude of the HRTF averaged across all locations within the cone of confusion 20 is held roughly constant. Therefore, and on average, the interaural difference for sounds located within a particular cone of confusion 20 will remain about the same for all values of α. Also, because the methods as described herein change only the magnitude of the HRTF and not the phase, the interaural time delays are preserved.

When the value of α is greater than 100% for an enhanced HRTF, the variations in spectrum that normally occur as a sound source is perceived to move to another location within a cone of confusion 20 are greater than a normal HRTF. The present invention results in HRTFs that provide more salient localization cues in the vertical dimension than would conventionally achieved.

The right ear signal 22 may be dine advanced or time delayed 72 by an appropriate number of samples to reconstruct the interaural time delay associated with the desired virtual source location. The resulting output signals 28, 34 are converted to analog signals 78, 80 via the D/A converter 36 to create left and right ear signals 74, 76, which are presented to left and right ear pieces 40, 42 (FIG. 3), respectively, of the headphones 44 (FIG. 3).

If desired or necessary, the lateral and vertical calculations may be performed in the reverse sequence, e.g., with the lateral calculations completed before the vertical calculations. Still in other embodiments of the present invention, the vertical and lateral HRTF filters may be combined into an integrated HRTF filter.

Figure 5:
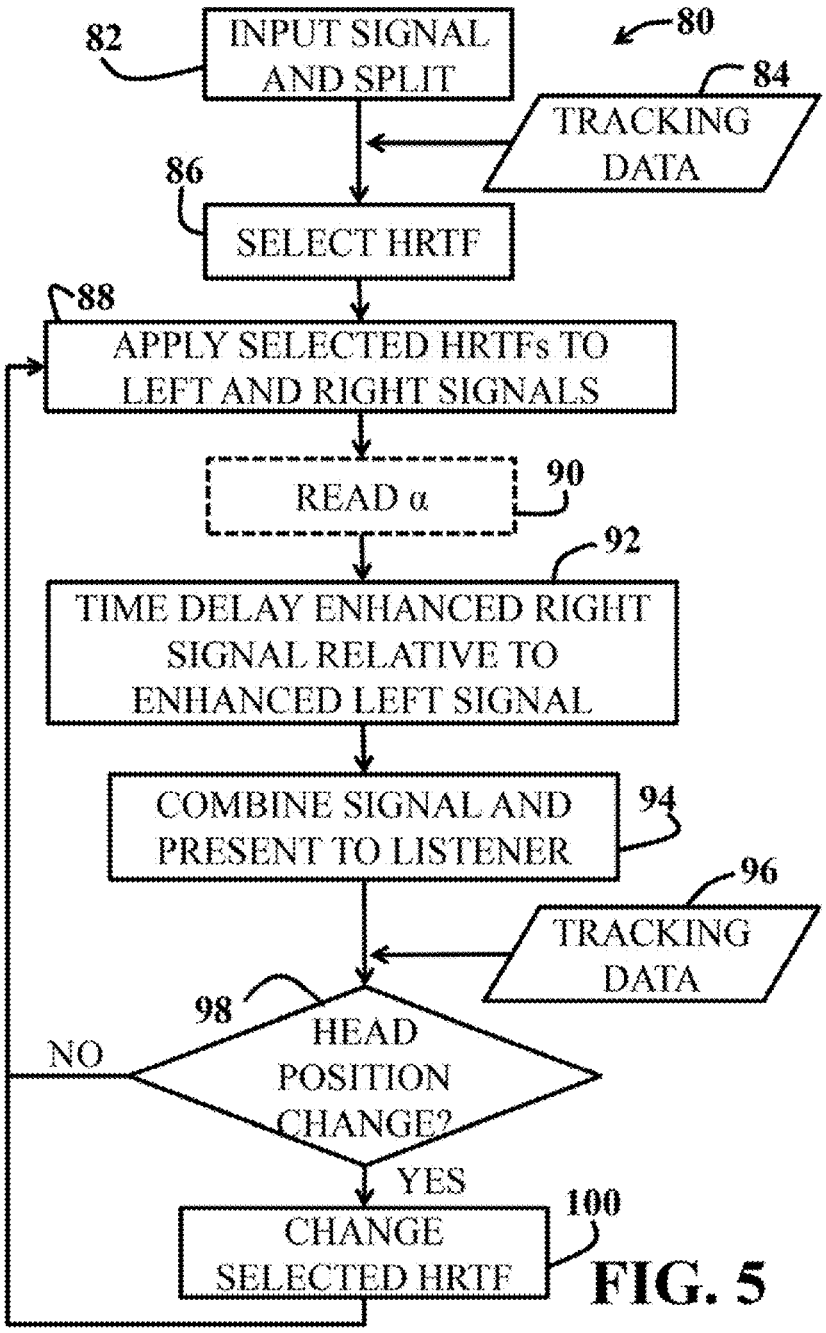
FIG. 5 is a flowchart illustrating a method of using the spatial audio system in accordance with another embodiment of the present invention.

Turning now to FIG. 5, and with reference also to FIG. 2, a flowchart 80 illustrating a method of using a spatial audio system 14 in accordance with another embodiment of the present invention is shown. According to this embodiment, the system 14 further includes a tracking system, such as a commercially-available IS-900 (InterSense, Billerica, Mass.), which is configured to detect a position and location of the listener's head 46 (FIG. 3) within space and to relate the position and location of the listener's head 46 (FIG. 3) to the location of the perceived sound source. In that regard, when the signal is input into the system 14 and split into left and right signals (Block 82), tracking data, indicative of the head position and location as determined by the tracking system, is input as well (Block 84). The system 14 may then select HRTFs (Block 86) from the LLUT 26 and RLUT 32 based on the relative location/position of the listener's head 46 (FIG. 3) and the location of the perceived sound source. The HRTFs are applied, such as the first and second filters 64, 66, 68, 70 of FIG. 4, and as described previously (Block 88).

If the system 12 includes a selectable enhancement factor, the system 14 reads α in optional Block 90. Otherwise, and if α is not variable, the system 14 continues.

With filtering complete, the time delay is applied to the enhance right signal relative to the enhance left signal (Block 92) so as to account for the interaural time delay, which may be, at least in part, dependent of the tracking data (Block 84) indicative to the location/position of the listener's head 46 (FIG. 3). The enhanced left signal and the time delayed, enhanced right signal may be combined and presented to the listener (Block 94).

Based on the real time tracking data (Block 96), the system 14 makes a determination (Decision Block 98) as to whether the listener's head location/position has changed since the initial inquiry (Block 84). If the listener's head location/position has not changed ("No" branch of decision block 98), then no change to the selected HRTF is made and the process returns to continue applying the same selected HRTF (Block 88). If the head location/position has changed ("Yes" branch of decision block 98), then the selected HRTF is changed (Block 100) to account for the change in the relative location/position of the listener's head 46 (FIG. 3) and the location of the perceived sound source. The new selected HRTF is then applied to the left and right signals in Block 88.

In accordance with another embodiment of the present invention, further enhancement of HRTF may include spherical harmonics related, to the vertical domain. In that regard, and after the log-magnitude response is determined (for example, $\mathcal{H}_{\phi_i,\theta_i}^{l/r}[k]=20\log_{10}(|H_{\phi_i,\theta_i}^{l/r}[k]|)$), the HRTF measurements may be interpolated to a continuous representation using a spherical harmonic expansion:

$$h=Yc$$

where $$h=[\mathcal{H}_{\phi_1,\theta_1}, \mathcal{H}_{\phi_2,\theta_2}, \ldots, \mathcal{H}_{\phi_S,\theta_S}]^T$$

$$c=[C_{00}, C_{1-1}, C_{10}, C_{11}, \ldots, C_{PP}]^T$$

$$Y=[y_{00}, y_{1-1}, y_{10}, y_{11}, \ldots, y_{PP}]^T$$

where coefficient vector, c, includes linear weights given to each spherical harmonic vector, and the column vectors comprising a system matrix, Y, may be formed by sampling one real-valued spherical harmonic basis function at the spatial location where the HRTFs were measured as:

$$y_{nm}=[Y_{nm}(\phi_1,\theta_1), Y_{nm}(\phi_2,\theta_2), \ldots, Y_{nm}(\phi_S,\theta_S)]^T$$

Figure 8:
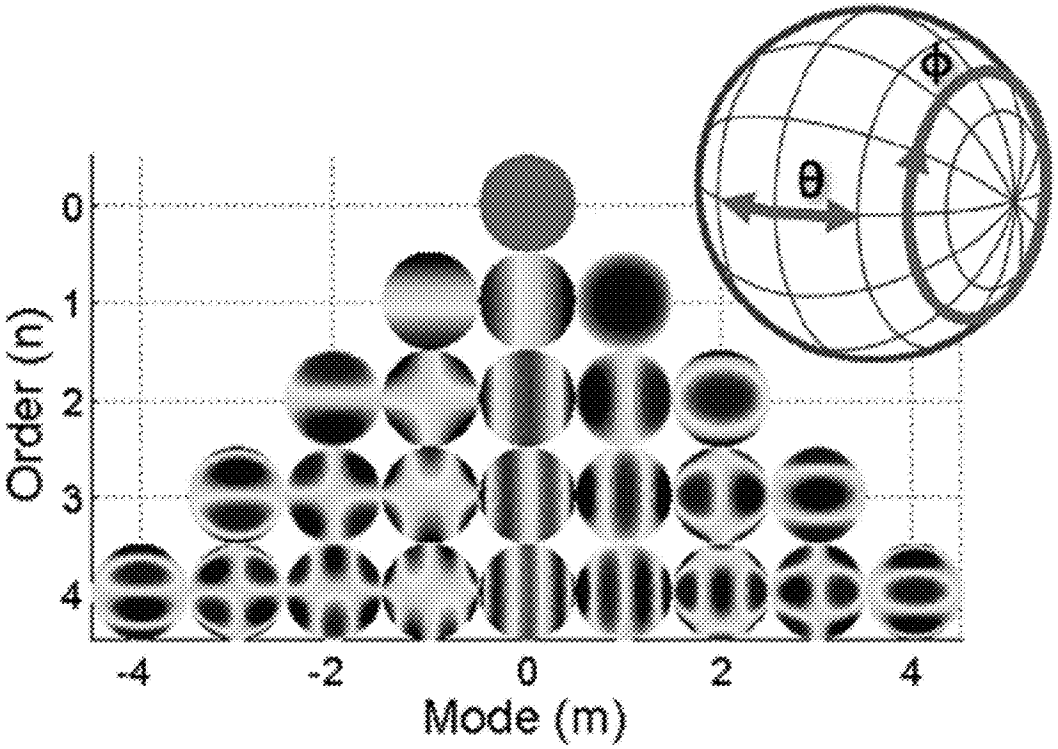
FIG. 8 is a graphic representation of a spherical harmonic basis function, shown in interaural-polar coordinates.

Exemplary spherical harmonic basis functions, $Y_{nm}(\phi,\theta)$, are shown in interaural-polar coordinates in FIG. 8 and defined as:

$$Y_{nm}(\phi,\theta)\begin{cases}\frac{(2n+1)}{4\pi}p_n^m\left(\cos\left(\frac{\pi}{2}-\theta\right)\right) & \text{if } m=0\\ \frac{(2n+1)}{4\pi}\frac{(n-|m|)!}{(n+|m|)!}p_n^{|m|}\left(\cos\left(\frac{\pi}{2}-\theta\right)\right)\cos(m\phi) & \text{if } m>0\\ \frac{(2n+1)}{4\pi}\frac{(n-|m|)!}{(n+|m|)!}p_n^{|m|}\left(\cos\left(\frac{\pi}{2}-\theta\right)\right)\sin(m\phi) & \text{if } m<0\end{cases}$$

where $P_n^{\mathcal{M}}$ represents an associated Legendre polynomial or order n and degree in, Associated Legendre polynomials may be defined in terms of traditional Legendre polynomials:

$$P_n^m(x)=(-1)^m(1-x^2)^{\frac{m}{2}}\frac{d^m}{dx^m}p_n(x)$$

where, $P_n(x)$ is given by Rodrigues' formula:

$$P_n(x)=\frac{1}{2^n n!}\frac{d^m}{dx^m}[(x^2-1)^n]$$

The spherical harmonic basis function of a certain order, n, and mode (degree), m, form a continuous function of the spherical angles $\{-\pi/2\leq\theta\leq\pi/2\}$, $\{-\pi\leq\phi\leq\pi\}$, which may be defined for any positive order ($0\leq n\leq\infty$), but may typically be truncated, to a finite order, P. For each spherical harmonic order, b, there are 2n+1 individual basis functions, which are designated by a mode number, $\{-n\leq m\leq n\}$. Accordingly, for a $P^{th}$ order spherical harmonic representation, there are $(P+1)^2$ basis functions.

In selecting an orientation of the spherical harmonic basis functions, for example, such that the coefficients in which $|m|=n$ capture the spatial variation of the HRTF, proper decomposition may be enhanced. Scaling the coefficients resultantly scales the vertical-polar spatial variation in a manner that is similar to the methods described above. Scaling may be defined as:

$$C'_{nm}\begin{cases}\left(\frac{\varepsilon}{100}\right)C_{nm} & \text{for } n>0 \text{ and } |m|=n\\ C_{nm} & \text{otherwise}\end{cases}$$

With new weights, $C_{nm}'$ calculated, the enhanced HRTF may be calculated at any arbitrary spatial direction $(\phi_j,\theta_j)$ by:

$$\mathcal{H}_{\phi_j,\theta_j}=[Y_{00}(\phi_j,\theta_j), Y_{-1,1}(\phi_j,\theta_j), \ldots, Y_{PP}(\phi_j,\theta_j)]c'$$

The present invention includes a spectral enhancement algorithm for the HRTF that is flexible and generalizable. It allows an increase in spectral contrast to be provided to all HRTF locations within a cone-of-confusion rather than for a single set of pre-identified confusable locations. The result is a substantial improvement in the salience of the spectral cues associated with auditory localization in the up/down and front/back dimensions and may improve localization accuracy, not only for virtual sounds rendered with individualized HRTFs, but for virtual sounds rendered with non-individualized HRTFs as well.

The system and methods according to the various embodiments of the present invention produce substantial improvements in localization accuracy in the vertical dimension for individualized and non-individualized HRTFs without negatively impacting performance in the left-right localization dimension. A few of the advantages of the embodiments of the present invention including faster response time, fewer chances for human interpretation error, and compatibility with existing auditory hardware.

Such systems and methods offer a capability that may be useful is in an aircraft cockpit display where it might be desirable to produce a threat warning tone perceived to originate from the location of the threat relative to the pilot. Still other applications may include unmanned aerial vehicle pilots, SCUBA divers, parachutists, astronauts, or, generally, any environment wherein the orientation to the environment may become confused and quick reorientation may be essential.

One potential advantage of the proposed enhancement system is that it results in much better auditory localization accuracy than existing virtual audio systems, particularly in the vertical-polar dimension. This advantage was verified in an experiment that measured auditory localization performance as a function of the level of enhancement both for individualized and non-individualized HRTFs.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Example 1

Figure 6A:
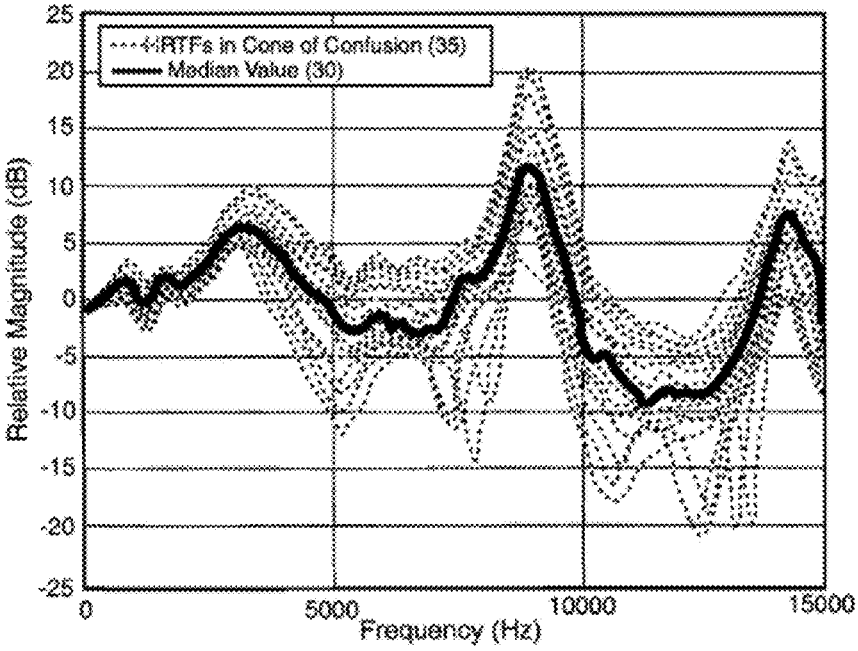
FIG. 6A is a graphic representation of the relative magnitude of the cone of confusion of FIG. 2 with respect to frequency.
Figure 6B:
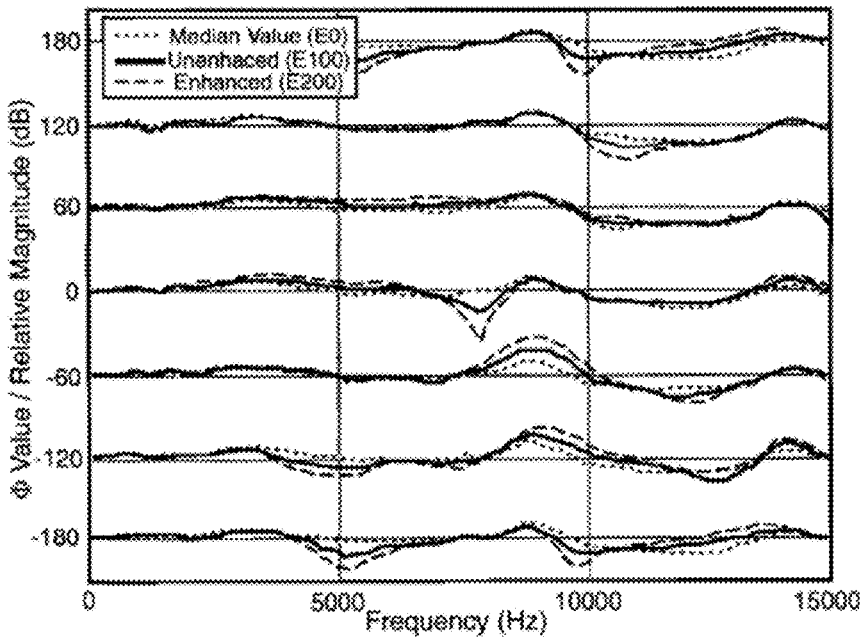
FIG. 6B is a graphic representation of an effect that HRTF enhancement, in accordance with one embodiment of the present invention, at seven different vertical angle locations ($\phi$) has on the magnitude frequency response of the HRTF and when the lateral angle ($\theta$) is fixed at 45 degrees.

FIGS. 6A and 6B show exemplary calculations of a right ear enhanced HRTF for source locations within the cone of confusion 20 (FIG. 1) at θ=45°. The dotted lines in FIG. 6A represent the HRTF $|H_{r,45°,\phi}(j\omega)|$ measured at five degree intervals in φ. The bold line in FIG. 6A represents a median magnitude HRTF across all of these values, $|H_{r,45°}^{Lat}(j\omega)|$. The solid black lines in FIG. 6B represent unenhanced HRTFs E100 measured at 60 degree intervals in φ, ranging from −180° to +180°. For comparison purposes, the dotted lines at each location of φ replot the median HRTF E0, which does not change with φ locations. The dashed lines in FIG. 6B represent the enhanced HRTF E200 having an α value of 200%. These curves show that the elevation-dependent spectral features of the HRTF E100 are greatly exaggerated in the enhanced HRTFs E200. A nice example of this effect is the notch that occurs at roughly 8 kHz in the unenhanced HRTF E100 for θ=45°, =0° (almost exactly in the center of FIG.

6B). There is no sign of this notch in the median HRTF E0 or in the unenhanced HRTF E 100 for any other location in ϕ. However, the notch is extremely prominent in the enhanced HRTF E200.

Example 2

Nine paid volunteers, (referred to as "listeners") ranging in age from 18 to 23, wearing DT990 headphones (Beyerdynamic Inc., Farmingdale, N.Y.) participated in localization experiments. The experiment took place with the listeners standing in the middle of a geodesic sphere (herein having a diameter of about 4.3 m) equipped with 277 full-range loudspeakers spaced roughly every 15° along an inside surface of the sphere. Each speaker is equipped with a cluster of four LEDs operably coupled to a head tracking device, for example, commercially-available an IS-900 (InterSense. Billerica, Mass.) mounted inside the sphere and used to create an LED "cursor" for tracking a direction of the listener's head or of a hand-held response wand. The LED light at a location in response to where the listener is pointing.

A set of individualized HRTFs for each listener was measured in the sphere using a periodic chirp stimulus generated from each loudspeaker position. These HRTFs were time-windowed to remove reflections and used to derive 256-point, minimum-phase and right ear HRTF filters for each speaker location within the sphere. A single value representing the interaural time delay for each source location was derived and corrected for the frequency response of the headphones.

The HRTFs were used to generate three sets of enhanced HRTFs. A baseline set of HRTFs having no enhancement (indicated as E100 in FIGS. 7A-7C), a first enhanced set of HRTFs where the elevation-dependent spectral features in the HRTF were increased 50% relative to normal (indicated as E150 in FIGS. 7A-7C), and a second enhanced set of HRTFs where the spectral features were double normal (indicated as E200 in FIGS. 7A-7C). Additionally, a set or five enhanced HRTFs (E100, E150, E200, E250, and E300 in FIGS. 7A-7C) were generated from HRTF measurements made on a Knowles Electronics Manikin for Auditory Research (KEMAR, G.R.A.S. Sound & Vibration A/S, Holte Denmark), which is a standardized anthropomorphic manikin commonly used for spatial audio research.

These processed HRTFs were used to collect localization responses. In that regard, listeners entered the sphere and put on the headset, which was equipped with the head tracking sensor. The headset was connected to a control computer that rendered processed HRTFs in real time using, the Sound Lab (SLAB) software library (MILLER, J. D, "SLAB: A software-based real-time virtual acoustic environment rendering system," In: 9th Int. Conf. on Aud. Disp., Espoo, Finland (2001)).

The listeners then completed a block of 44-88 localization trials. Each trial began with ensuring the listener's head was facing a reference-frame original. For example, a visual cursor (for example, an LED) at a speaker located in direction of the listener's head was turned on. The visual cursor moved spatially moved to the speaker located at the origin.

With the listener facing the origin, the listener initiated the onset of a 250 ms burst of broadband noise (15 kHz bandwidth) that was processed to simulate one of the 224 possible speaker locations having, an elevation greater than −45°. The listener pointed the listener's response wand in the direction of the perceived location of the sound source and pressed a response button. The direction of the response wand may be indicated by a visual cursor, as described above. Feedback was provided by turning on a visual cursor at the actual location of the sound source, which the listener may acknowledged by a button press. The listener was again turned oriented to the original.

A total of 12 different conditions were tested with each listener. Three of the conditions were "individualized" HRTF conditions where the listeners heard their own HRTFs, which were processed with the enhancement procedure at the E100, E159, or E200 level. Three of the conditions were "non-individualized" HRTF conditions, e.g., where the listener heard E100, E150, or E200 enhanced HRTFs based on measurements from a different listener. HRTFs for two of the nine listeners were selected for use as "non-individualized" HRTFs while and all other listeners heard HRTFs from these two listeners. The two listeners used for the non-individualized HRTFs listened to the other's HRTFs in the non-individualized condition, i.e., not their own.

Five of the conditions involved HRTFs measured on the KEMAR manikin and processed at the E100, F 150, E200, E250, or E300 level.

Another condition was a control condition where the listener did not wear headphone and the localized stimuli were presented directly from the loudspeakers in the sphere. Listeners heard the same HRTF condition throughout a block of trials and would often collect two or three blocks of trials per 30 minute experimental session. Over the course of the experiment, which lasted several weeks, each listener participated in a minimum of 132 trials in each of the 12 conditions of the experiment.

When the enhancement algorithm was applied to the HRTFs, performance increased across all conditions tested. In the individualized condition, the E150 condition improved overall localization performance by approximately 3 degrees, from 16° to 13°, bringing performance up to almost exactly the same level achieved in the loudspeaker control condition. However, additional enhancement to the E200 level in the individualized condition actually degraded performance, which would suggest that, in the individualized HRTF case, over-enhancement may distort the spectral HRTF cues too much for listeners to take full advantage of their inherent experience with their own transfer functions. However, no such limitations were found for the improvements provided by enhancement in the non-individualized and KEMAR conditions. In those conditions, overall angular errors systematically decreased at the enhanced increased from E100 to E200, reducing the error in the non-individualized condition from roughly 28° to 22°. In the KEMAR condition, even greater improvements were obtained for enhancement levels out to E300. From these results, it is clear that the HRTF enhancement procedure is very effective for improving performance in localization tasks.

The improvements in the vertical dimension performance provided by the enhancement algorithm are dramatic, resulting in as much as a 33% reduction in vertical localization error. These results clearly show that the enhancement procedure was very effective at achieving its goal of improving the salience of the spectral cues that listeners use to determine the locations of sounds within a single cone of confusion.

Figure 7A:
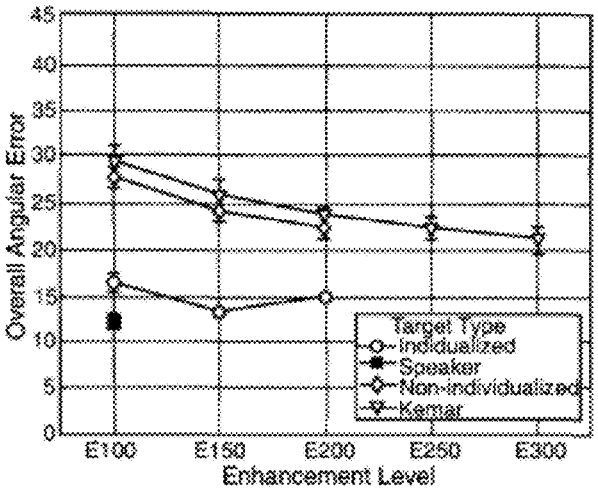
FIGS. 7A-7C graphic representations of performance improvements implementing HRTF enhancement according to one embodiment of the present invention and showing an error in localization accuracy of virtual sounds with respect to varying enhancement levels.
Figure 7B:
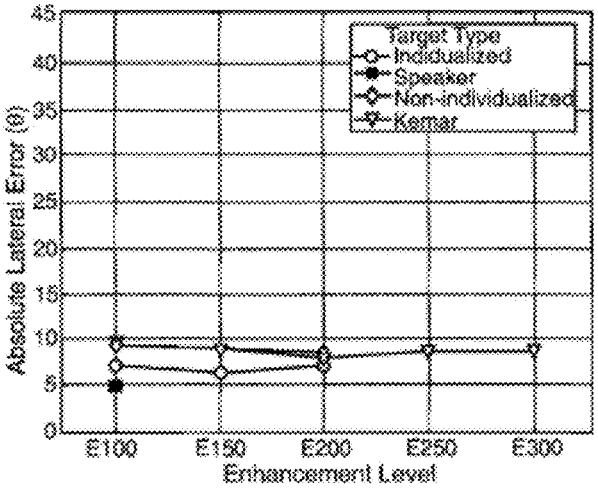
Figure 7C:
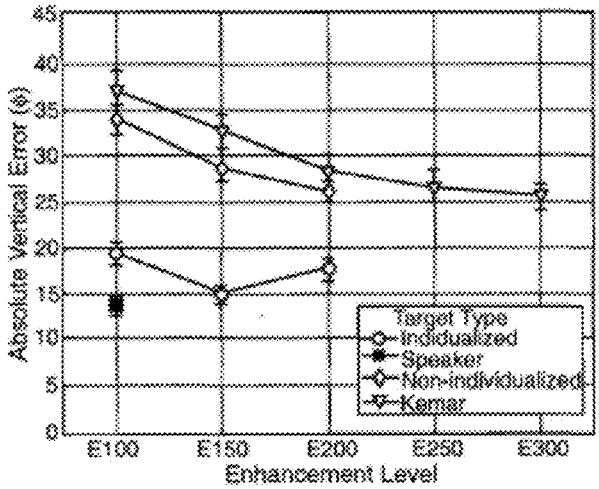

The results of the psychoacoustic testing in FIGS. 7A, 7B, and 7C demonstrate that one advantage of the HRTF enhancement algorithm is a substantial improvement in localization accuracy of virtual sounds in the vertical dimension. However, the system has some other advantages compared to other methods that have been proposed to improve virtual audio localization performance.

The present invention enhancement technique makes no assumptions about how the HRTFs were measured. The method does not require any visual inspection to identify the peaks and notches of interest in the HRTF, nor does the method require any hand-tuning of the output filters to ensure reasonable results. Also, and because the method is applied relative to the median HRTF within each cone of confusion, the method ignores characteristics of the HRTF that are common across all source locations. Thus, the method may be applied to an HRTF that has already been corrected to equalize for a particular headphone response without requiring any knowledge about how the original HRTF was measured, what the original HRTF looked like prior to headphone correction, or how that headphone response was implemented.

The proposed invention has been shown to provide substantial performance improvements for individualized HRTFs, presumably, in part, because it overcomes the spectral distortions that typically occur as a result of inconsistent headphone placement. The various embodiments of the algorithm and method disclosed herein do not require judgments to be made about particular pairs of locations that produce localization errors and need to be enhanced. When the enhancement parameter, $\alpha$, is greater than 100%, the algorithm provides au improvement in spectral contrast between any two points located anywhere within a cone of confusion.

Because the system works by enhancing existing localization cues rather than adding new ones, listeners are able to take advantage of the enhancements without any additional training. The HRTF enhancement system may be applied to any current or future implementation of a head-tracked virtual audio display. The enhancement system may have application where HRTFs or HRTF-related technology is used to provide enhanced spatial cueing to sound and, in particular, speaker-based "transaural" applications of virtual audio and headphone-based digital audio systems designed to simulate audio signals arriving from fixed positions in the free-field, such as the Dolby Headphone system.

There are many possible applications where it may be desirable to divide the head-related transfer function into a lateral component and a vertical component, and then to apply an enhancement algorithm differentially to the vertical component of the HRTF. This might include a linear enhancement factor that varies as a function of frequency, which could be defined as a function of frequency (i.e., $\alpha(f)$), or a linear enhancement factor that varies with a desired apparent source direction, or sonic combination thereof. It may also include some non-linear processing, such as an enhancement factor applied only to peaks in the vertical HRTF but not to dips.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope or the general inventive concept.

What is claimed is:

1. A method of enhancing vertical polar localization of a head related transfer function defining a left frequency-dependent audio gain, a right-frequency-dependent audio gain, and an interaural time delay for a plurality of perceived source locations, the method comprising:

splitting an audio signal into a left audio signal and a right audio signal;

generating a left output signal by:

determining a log lateral component of the left frequency-dependent audio gain that is equal to a median log left frequency-dependent audio gain for all left audio signals having a desired one of the plurality of perceived source locations and applying the log lateral component of the left frequency-dependent audio gain to the left lateral magnitude of the left audio signal; and determining a log vertical component of the left frequency-dependent audio gain that is equal to a product of a first enhancement factor and a difference between the left frequency-dependent audio gain at the desired one of the plurality of perceived source locations and the left lateral magnitude of the left audio signal and applying the log vertical component of the left frequency-dependent audio gain to the left vertical magnitude of the left audio signal;

generating a right output signal by:

determining a log lateral component of the right frequency-dependent audio gain that is equal to a median log right frequency-dependent audio gain for all right audio signals having the desired one of the plurality of perceived source locations and applying the log lateral component of the right frequency-dependent audio gain to the right lateral magnitude of the right audio signal; and determining a log vertical component of the right frequency-dependent audio gain that is equal to a product of a second enhancement factor and a difference between the right frequency-dependent audio gain at the desired one of the plurality of perceived source locations and the right lateral magnitude of the right audio signal and applying the log vertical component of the right-frequency-dependent audio gain to the right vertical magnitude of the right audio signal;

time delaying the right output signal with respect to the left output signal in accordance with the interaural time delay; and delivering the left and right output signals to left and right ears, respectively, of a listener.

2. The method of claim 1, wherein the enhancement factor is selected by the listener in real time.

3. The method of claim 1, further comprising:

tracking a position of the listener's head; and adjusting the time delaying with respect to the position of the listener's head.

4. The method of claim 3, further comprising:

generating a tone having a volume and a frequency, wherein at least one of the volume and the frequency changes with a change in the position of the listener's head.

5. The method of claim 3, wherein the first enhancement factor, the second enhancement factor, or both change with a change in the position of the listener's head.

6. The method of claim 1, wherein the first enhancement factor equals the second enhancement factor.

7. A method of using a head related transfer function to enhance vertical polar localization of an audio signal, the method comprising:

determining a magnitude response for each channel of the audio signal by calculating a log lateral component of a frequency-dependent audio gain that is equal to a median log left frequency-dependent audio gain for all audio signals having a desired perceived source location;

for each channel, decomposing the determined magnitude response to a polar-coordinate system;

for each channel, determining a difference between a frequency-dependent audio gain and a lateral component of the decomposed response at the perceived source location;

for each channel, enhancing the determined difference by an enhancement factor; and combining the enhanced differences for each channel of the audio signal.

8. The method of claim 7, further comprising:

delaying a first channel of the audio signal with respect to a second channel of the audio signal in accordance with an interaural time delay.

9. The method of claim 7, wherein enhancing the difference includes interpolating a vertical component to a continuous representation with a spherical harmonic expansion.

10. A method of applying a head related transfer function to each channel of an audio signal, the method comprising:

enhancing a left lateral magnitude of each channel of the audio signal by, for each channel, determining a log lateral component of a frequency-dependent audio gain that is equal to a median log frequency-dependent audio gain for all audio signals of the channel having a desired one of a plurality of perceived source locations and applying the log lateral component of the frequency-dependent audio gain to the lateral magnitude of the channel of the audio signal; and enhancing a vertical magnitude of each channel of the audio signal by, for each channel, determining a log vertical component of the frequency-dependent audio gain that is equal to a product of an enhancement factor and a difference between the frequency-dependent audio gain at the desired one of the plurality of perceived source locations and the left lateral magnitude of the audio signal and applying the log vertical component of the frequency-dependent audio gain to the vertical magnitude of the channel of the audio signal.

11. The method of claim 10, further comprising:

time delaying a first channel of the audio signal with respect to a second channel of the audio signal in accordance with an interaural time delay.

12. The method of claim 10, wherein enhancing a vertical magnitude of the audio signal includes interpolating the vertical component to a continuous representation with a spherical harmonic expansion.

* * * * *